US005704497A

United States Patent [19]

Wyatt

[11] Patent Number: 5,704,497

[45] Date of Patent: Jan. 6, 1998

[54] ROTATING DISPLAY RACK

[75] Inventor: Philip D. Wyatt, Neosho, Mo.

[73] Assignee: L & P Property Management Company, Chicago, Ill.

[21] Appl. No.: 585,483

[22] Filed: Jan. 16, 1996

[51] Int. Cl.[6] ..... A47F 5/00

[52] U.S. Cl. ..... 211/163; 211/181; 211/187; D6/458

[58] Field of Search ..... 211/163, 181, 211/187, 149; D6/458, 463, 464, 465

[56] References Cited

U.S. PATENT DOCUMENTS

| | | | |
|---|---|---|---|
| D. 206,699 | 1/1967 | Douglas | D6/458 |
| D. 229,648 | 12/1973 | Howard | D6/458 |
| D. 288,038 | 2/1987 | Henning | D6/458 |
| 1,569,365 | 1/1926 | Goldberg | 211/163 |
| 3,051,319 | 8/1962 | Glaser | 211/181 X |
| 3,092,258 | 6/1963 | Bleed | 211/163 |
| 3,315,819 | 4/1967 | Kingsbery | 211/163 |
| 3,524,554 | 8/1970 | Ruhnke | 211/163 |
| 3,679,066 | 7/1972 | Leffeld | 211/181 X |
| 3,921,813 | 11/1975 | Cimino | 211/163 |
| 4,296,866 | 10/1981 | Learnard | 211/163 X |
| 4,303,163 | 12/1981 | Henry | 211/181 X |
| 4,732,283 | 3/1988 | Schmidt | 211/163 X |
| 4,960,214 | 10/1990 | Sayers | 211/181 X |
| 5,052,563 | 10/1991 | Camp | 211/163 X |

*Primary Examiner*—Robert W. Gibson, Jr.
*Attorney, Agent, or Firm*—Wood, Herron & Evans L.L.P.

[57] ABSTRACT

A spinning display rack includes a base, a pole supported in a vertical position by the base, a top cap rotatably supported by the pole, a bottom cap rotatably supported by the pole, and a pair of generally U-shaped display grids attached in a back-to-back relationship to the top and bottom caps. The top and bottom caps are formed from sheet metal and have flanged holes for receiving the pole. The caps are supported by pins mounted on the pole. The display grids have vertical grid members whose ends extend through holes formed in the top and bottom caps and are secured to the caps with friction cap nuts. Shelves are mounted within the U-shaped enclosures of the display grids.

12 Claims, 3 Drawing Sheets

ROTATING DISPLAY RACK

FIELD OF THE INVENTION

This invention relates to racks for displaying merchandise. More particularly, this invention relates to free-standing display racks capable of rotating about a vertical axis.

BACKGROUND OF THE INVENTION

Free-standing display racks that rotate about a vertical axis are well known. In a conventional rotating display rack, a base supports a vertical pole around which rotate a number of display panels. Typically, the display panels are held together and mounted on the pole by means of an assortment of attachment hardware such as cotter pins, large flat washers, thrust bearings, collars, and other assemblies. Although these kinds of attachment hardware are mechanically effective, they are not visually appealing. Furthermore, they require a significant number of parts, leading to longer assembly times and therefore higher production costs.

It has therefore been an object of the present invention to provide a spinning display rack in which the means for attaching the panels together and for mounting the panels on the pole are aesthetically appealing.

It has been a further object of the present invention to provide means for attaching display panels to each other and for mounting the panels on a pole with fewer parts without impairing the effectiveness of the attachment means.

Still another object of the present invention has been to simplify the means for attaching display panels on rotating racks in order to reduce assembly time and production costs.

SUMMARY OF THE INVENTION

These and other objects are accomplished by a spinning display rack incorporating a unique means for attaching a pair of display panels in a back-to-back relationship and mounting the panels to a vertical pole. Such a display rack includes a base, a pole supported in a vertical position by the base, top and bottom caps rotatably supported by the pole, and a pair of display panels attached to the top and bottom caps so that a back surface of one panel is facing a back surface of the other panel.

In one embodiment of the invention, the display panels are formed from wire grid having a plurality of horizontal grid members affixed to a plurality of vertical grid members. On each panel, a pair of the vertical grid members have ends that extend upward beyond the uppermost horizontal grid member and engage the top cap so as to attach each panel to the top cap. Similarly, a pair of vertical grid members on each panel extend down below the lowermost horizontal grid member and engage the bottom cap so as to attach each panel to the bottom cap.

Preferably, each cap is mounted on the pole by means of a flanged hole in a horizontal surface of the cap. The flanged hole is slightly larger in diameter than the pole in order to permit the cap to rotate freely about the pole. The pole has means for supporting the top and bottom caps at predetermined heights on the pole. This may be accomplished by means of pins mounted in holes through the pole, with the ends of the pins extending beyond the pole and supporting the caps.

Preferably, the caps are made of sheet metal, and have holes formed in a horizontal surface for receiving the ends of the vertical grid members on each display panel. These vertical grid members are attached to the caps by means of, for example, friction cap nuts.

In a preferred embodiment, each display grid is bent to form a generally U-shaped enclosure, with a major portion of the grid forming the base of the U, and two side portions forming the legs of the U. A number of shelves may be mounted to each panel within the U-shaped enclosure. The shelves are mounted to the grids by means of hooks that engage the horizontal grid members. The hooks provide a releasable mounting means so that the shelves may be placed at any desired height and may easily be rearranged.

In order to improve the rigidity of the attachment of the panels, the top cap preferably has two flanged edges directed downward, with one flange engaging an uppermost horizontal grid member of one display grid, and the other flange engaging an uppermost horizontal grid member of the other display grid. Likewise, the bottom cap has two flanged edges directed upward, with one flange engaging a lowermost horizontal grid member of one display grid, and the other flange engaging a lowermost horizontal grid member of the other display grid.

BRIEF DESCRIPTION OF THE DRAWINGS

The aforementioned objects, features, and advantages of the invention will be better understood with reference to the drawings taken in conjunction with the following detailed description of the invention, in which.

DETAILED DESCRIPTION OF THE INVENTION

Figure 1:
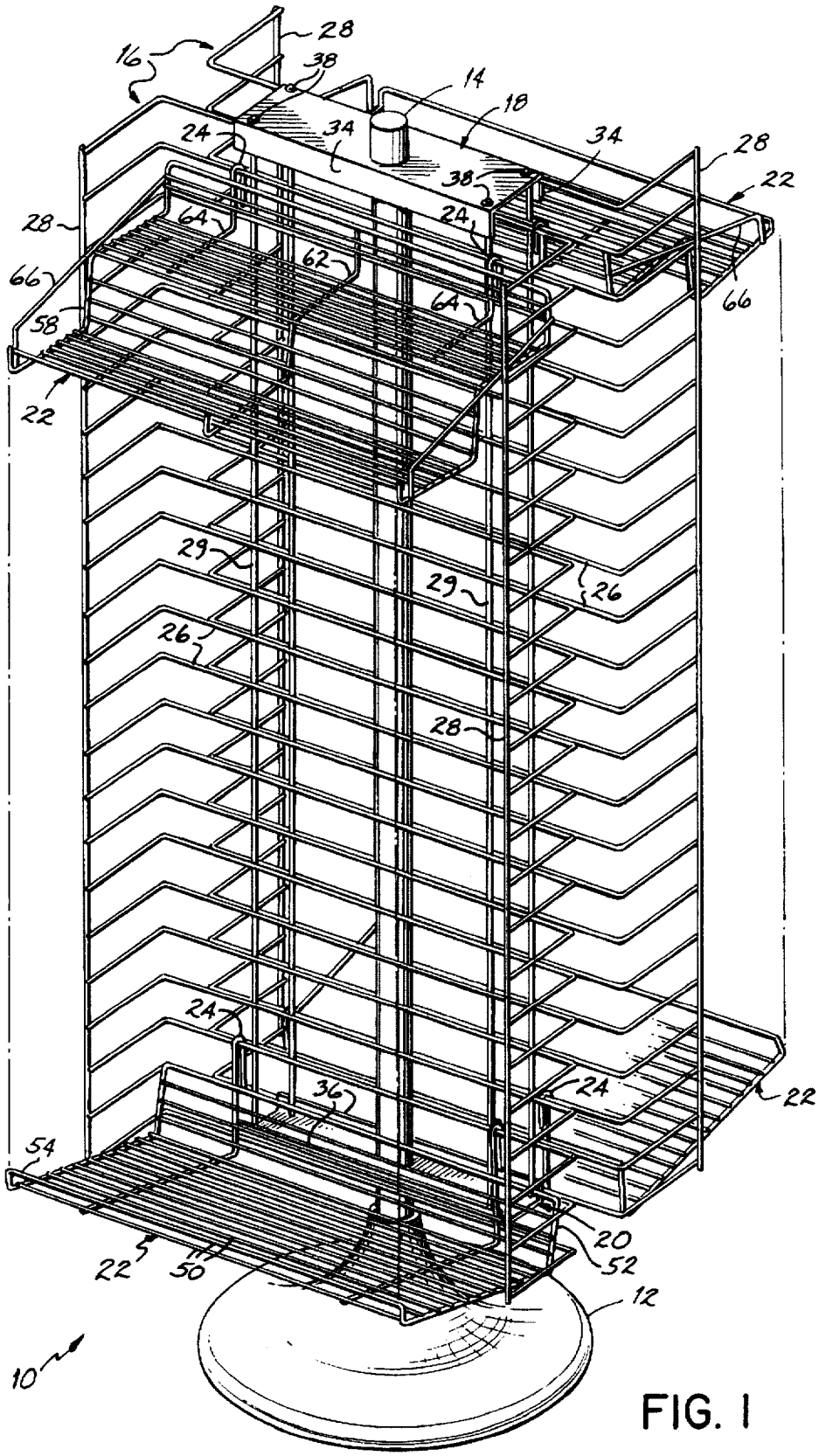
FIG. 1 is a perspective view of one embodiment of a spinning display rack according to the present invention.

With reference to FIG. 1, a display rack 10 comprises a base 12, a pole 14 supported in a vertical position by the base 12, a top cap 18 mounted on the pole 14, a bottom cap 20 mounted on the pole 14, and a pair of display grids or panels 16 attached to the top cap 18 and the bottom cap 20. A plurality of shelves 22 are mounted on the display panels 16.

Figure 2:
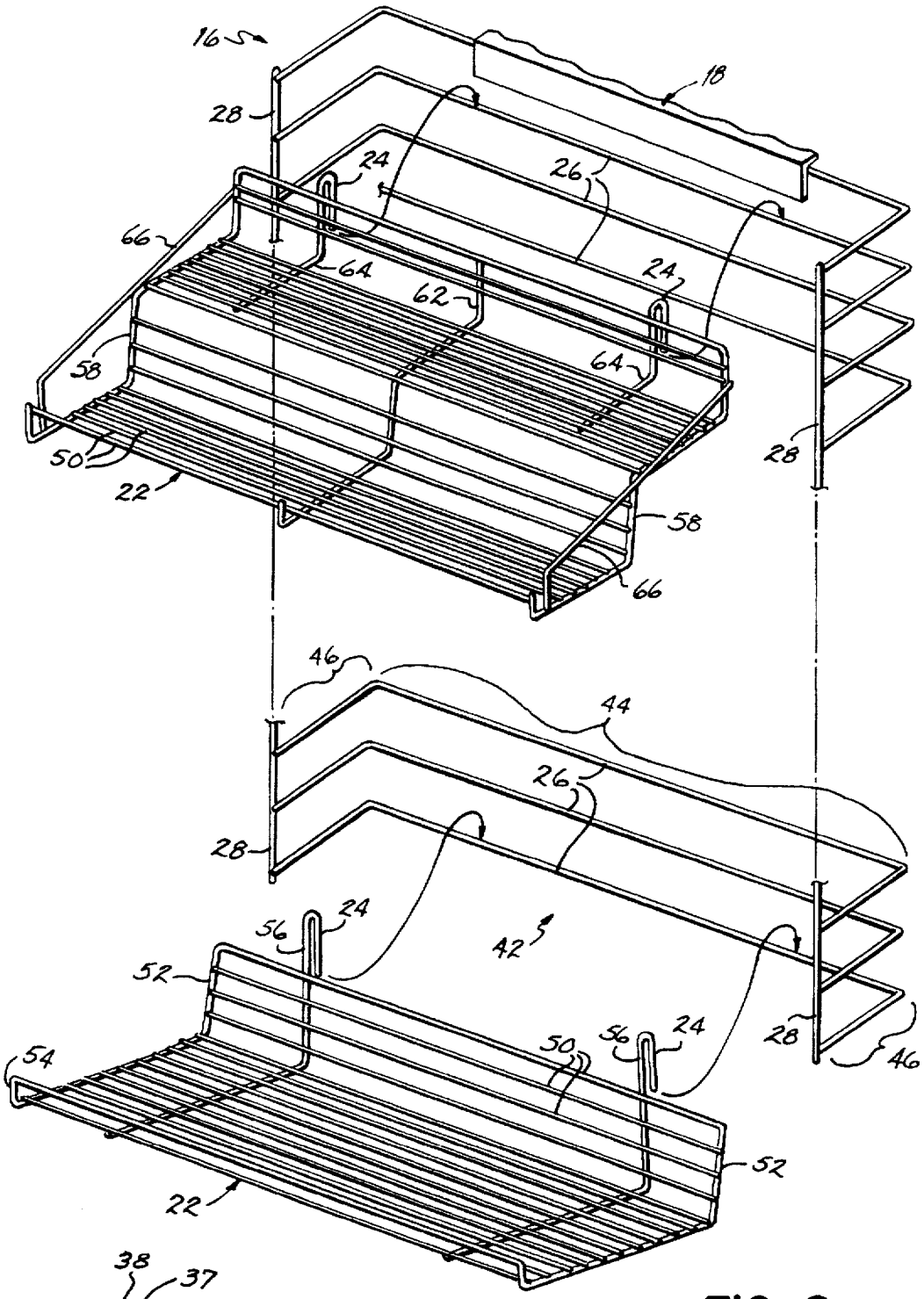
FIG. 2 is an exploded perspective view of a portion of one display grid and shelves showing how the shelves are mounted on the grid.

With reference to FIG. 2, each display panel 16 is made up of a plurality of horizontal grid members 26 attached to endmost vertical grid members 28 and intermediate vertical grid members 29. The shelves 22 have hooks 24 which engage any of the horizontal grid members 26.

Also as shown in FIG. 2, each display grid 16 is formed into a U-shaped enclosure 42. The U-shaped enclosure has a major portion 44 and two side portions 46. The shelves 22 are received by and are contained partially within the U-shaped enclosure 42.

In a preferred embodiment of the invention, each display grid 16 is constructed by initially forming a flat orthogonal wire grid made up of a plurality of horizontal grid members 26 welded to two endmost vertical grid members 28 and two intermediate vertical grid members 29. The horizontal grid members 26 are constructed of equal lengths of seven gauge (0.177 inch diameter) wire. The endmost vertical grid members 28 are constructed of equal lengths of 0.25 inch diameter wire. The intermediate vertical grid members 29 are constructed of equal lengths of 0.25 inch diameter wire, and are slightly longer than the endmost vertical grid members 28.

A flat orthogonal grid is formed by arranging the horizontal grid members 26 into a substantially planar array with all of the grid members 26 being parallel and with a substantially constant spacing between each pair of adjacent grid members 26. One endmost vertical grid member 28 is then welded to one end of each horizontal grid member 26, and the other endmost vertical grid member 28 is welded to the opposite end of each horizontal grid member 26. The two intermediate vertical grid members 29 are placed parallel to each other and orthogonal to the horizontal grid members 26 and are welded to the horizontal grid members 26 between the endmost vertical grid members 28, with the ends of the members 28 extending slightly beyond the uppermost and lowermost horizontal grid members. The orthogonal grid thus formed is symmetric about a line through the midpoints of the horizontal grid members 26.

The orthogonal grid is then bent at two places so as to form a generally U-shaped enclosure having a major portion 44 and two side portions 46. The side portions 46 are substantially perpendicular to the major portion 44.

In a preferred embodiment, the shelves 22 are of two types, a single-tiered shelf as shown in the lower portion of FIG. 2, and a two-tiered shelf as shown in the upper portion of FIG. 2. The single-tiered shelf is constructed from a plurality of crosswise grid members 50 welded to a pair of edge reinforcing members 52 and a pair of intermediate support members 56. The edge reinforcing members 52 and the intermediate support members 56 are bent to form generally L-shaped members with one leg of each L-shaped member providing support for crosswise grid members 50 that make up the generally horizontal load-bearing surface of the shelf 22, and the other leg of each L-shaped member providing support for the crosswise grid members 50 that make up the generally vertical riser portion of the shelf 22. The crosswise grid members 50 are arranged in a parallel regularly spaced fashion along both legs of the L-shaped members 52 and 56 and are welded thereto. The outermost ends of edge reinforcing members 52 are bent upward and combine with an outermost crosswise grid member 50 to form a lip 54. Intermediate support members 56 have upper ends that are bent to form hooks 24 for engaging horizontal grid members 26 on display panels 16, as shown in FIG. 2.

The two-tiered shelf shown in the upper portion of FIG. 2 is constructed similarly to the single-tiered shelf. A plurality of crosswise grid members 50 are welded to a pair of edge support members 58, a center support member 62, and a pair of intermediate support members The edge support members 58 and center support member 62 are each bent into a generally stair-step configuration having a lower generally horizontal portion joined to a lower generally vertical portion, which is joined to an upper generally horizontal portion joined to an upper generally vertical portion. The lower generally horizontal portions of members 58 and 62 provide support for crosswise grid members 50 that form the load-bearing surface of the lower tier of the two-tiered shelf 22. Similarly, the upper generally horizontal portions of members 58 and 62 provide support for crosswise grid members 50 that form the load-bearing surface of the upper tier of two-tiered shelf 22. The crosswise members 50 are arranged in a parallel regularly spaced fashion along both lower and upper horizontal and vertical portions of members 58 and 62 and are welded thereto. Intermediate support members 64 are bent into generally L-shaped configurations and are welded to the upper-tier crosswise grid members 50. The intermediate support members 64 have upper ends that are bent to form hooks 24 for engaging horizontal grid members 26 on display panels 16. The two-tiered shelf 22 has additional reinforcing members 66 welded to each edge support member 58 at the upper vertical portion and the lower horizontal portion in order to provide additional strength for the two-tiered shelf.

Figure 3:
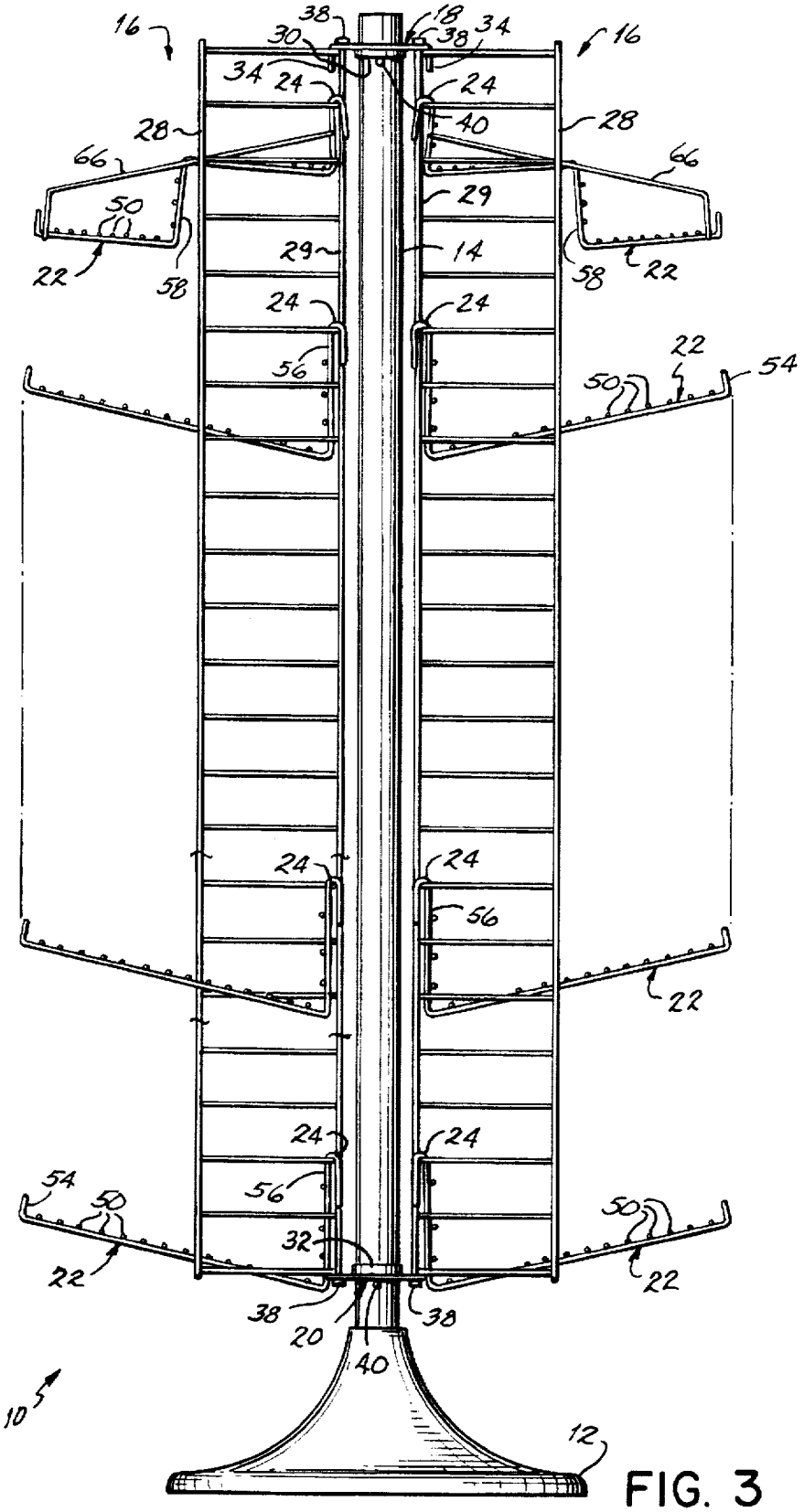
FIG. 3 is a side elevation view of the display rack of FIG. 1.

With reference to FIGS. 2 and 3, the top cap 18 has flanged edges 34 that engage an uppermost horizontal grid member 26 on each display grid 16. Similarly, the bottom cap 20 has flanged edges 36 that engage a lowermost horizontal grid member 26 on each display grid 16.

With reference to FIG. 3, the top cap 18 has a flanged hole 30 formed in a horizontal surface of the top cap 18. Likewise, the bottom cap 20 has a flanged hole 32 formed in a horizontal surface of the bottom cap 20. Flanged holes 30 and 32 are slightly larger in diameter than the pole 14 so as to permit the top cap 18 and bottom cap 20 to rotate freely about the pole 14. Pins 40 mounted on pole 14 support the top cap 18 and bottom cap 20.

The top cap 18 and bottom cap 20 preferably are constructed of sheet metal and are substantially identical to each other. Each cap is formed from a rectangular piece of sheet metal stock having a length approximately twice its width. A flanged hole is formed in the center of the rectangular piece. The long edges of the rectangular piece are bent to form flanges approximately perpendicular to the plane of the rectangular piece. Four holes are then formed in the rectangular piece, one hole adjacent to each of the four corners of the cap. The spacing between the holes on each long edge is equal to the spacing between the intermediate vertical grid members 29 on panels 16.

Figure 4:
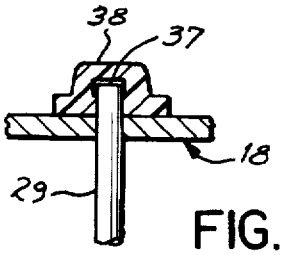
FIG. 4 is an enlarged cross-section of a portion of the top cap showing the attachment of a display panel to the top cap via a vertical grid member and cap nut.

As shown in FIG. 4, the display grids 16 are attached to top cap 18 and bottom cap 20 by means of intermediate vertical grid members 29 whose ends 37 extend through the four holes in top cap 18 and the four holes in bottom cap 20. The ends 37 of intermediate vertical grid members 29 are attached to the caps 18 and 20 by means of cap nuts 38, which prevent the grid members 29 from being withdrawn from the holes in caps 18 and 20.

It will thus be appreciated that the present invention provides a unique spinning display rack having an aesthetically appealing appearance and requiring fewer attachment parts than conventional spinning display racks. From the foregoing disclosure of the general concepts of the invention along with the detailed description of the preferred embodiments, those skilled in the art will readily comprehend various modifications to which the invention is susceptible. We therefore desire to be limited only by the scope of the following claims.

I claim:

1. A spinning display rack comprising a base, a pole supported in a vertical position by said base, top and bottom caps rotatably supported by said pole, said caps being generally in vertical alignment with one another, and a pair of display panels attached to said top and bottom caps such that a back surface of one said panel is facing a back surface of the other said panel, each said panel comprising a wire grid including a plurality of horizontal grid members joined to a pair of vertical grid members extending the entire height of said panel, each said panel being attached to said top and bottom caps by said pair of vertical grid members.

2. The display rack of claim 1 further comprising a plurality of shelves releasably mounted on said panels.

3. The display rack of claim 2 wherein said shelves are releasably mounted on said panels by means of hooks attached to said shelves, said hooks engaging said horizontal grid members.

4. The display rack of claim 3 wherein each said cap is rotatably supported by said pole by means of a flanged hole formed in a horizontal surface of said cap, said hole being slightly larger in diameter than said pole so as to permit said cap to rotate freely about said pole, said pole having means for supporting said caps at predetermined heights on said pole.

5. The display rack of claim 4 wherein said means for supporting said caps at predetermined heights comprise pins mounted in holes through said pole, said pins having ends extending outward from said pole for supporting said caps.

6. The display rack of claim 1 wherein said pair of vertical grid members have ends that extend through holes in said top and bottom caps, said ends having attached thereto means for preventing said ends from being withdrawn from said holes, and thereby serving to attach said panels to said top and bottom caps.

7. A spinning display rack comprising a base, a pole supported in a vertical position by said base, a top cap rotatably supported by said pole, a bottom cap rotatably supported by said pole, a pair of display panels each having a plurality of horizontal grid members affixed to a plurality of vertical grid members, and a plurality of shelves supported by said horizontal grid members, at least two of said vertical grid members on each said panel having ends that engage said top and bottom caps so as to attach each said panel to said caps.

8. The display rack of claim 7 wherein said panels are attached to said caps such that a back surface of one said panel is facing a back surface of the other said panel.

9. The display rack of claim 8 wherein each said cap has a flanged hole formed in a horizontal surface of said cap for receiving said pole, said hole having a diameter slightly larger than said pole so as to permit said cap to rotate freely about said pole.

10. The display rack of claim 9 wherein said top cap has flanged edges that engage an uppermost said horizontal grid member on each said panel, and said bottom cap has flanged edges that engage a lowermost said horizontal grid member on each said panel.

11. The display rack of claim 10 wherein each said panel has two side portions attached to a major portion so as to form a generally U-shaped enclosure, said shelves being disposed within said U-shaped enclosures.

12. A spinning display rack comprising a base, a pole supported in a vertical position by said base, a top cap rotatably supported by said pole, a bottom cap rotatably supported by said pole, a pair of display panels each having a plurality of horizontal grid members affixed to a plurality of vertical grid members, at least two of said vertical grid members on each said panel having ends that engage said top and bottom caps so as to attach each said panel to said caps, each said panel having two side portions attached to a major portion so as to form a generally U-shaped enclosure, and a plurality of shelves mounted on said panels within said U-shaped enclosures.

* * * * *